United States Patent [19]

Pytlewski

[11] 4,320,685

[45] Mar. 23, 1982

[54] STRINGED MUSICAL INSTRUMENT

[76] Inventor: Roger Pytlewski, 7644 Mar Ave., La Jolla, Calif. 92037

[21] Appl. No.: 211,707

[22] Filed: Dec. 1, 1980

[51] Int. Cl.[3] ..... G10D 3/04

[52] U.S. Cl. ..... 84/291; 84/297 R; 84/298; 84/307

[58] Field of Search ..... D17/14, 17, 19, 21; 84/173, 267, 268, 291, 293, 297 R, 298, 299, 307

[56] References Cited

U.S. PATENT DOCUMENTS

| | | | |
|---|---|---|---|
| 175,332 | 8/1955 | Bivens . | |
| 4,031,798 | 6/1977 | Sider | 84/291 |
| 4,041,830 | 8/1977 | Doane | 84/305 |

FOREIGN PATENT DOCUMENTS

| | | | |
|---|---|---|---|
| 8166 | of 1906 | United Kingdom | 84/267 |

*Primary Examiner*—Lawrence R. Franklin
*Attorney, Agent, or Firm*—Howard L. Johnson

[57] ABSTRACT

A guitar having a split level top of its sound box which thus is formed at two different (vertically separated) levels and connected by an angular cross bridge to which one end of the strings is anchored so as to directly vibrate the chamber. The result is an increased sound volume and resonance persistance which is achieved without the distortion that may result from electronic amplification when applied to conventional guitars or other stringed musical instruments.

7 Claims, 6 Drawing Figures

STRINGED MUSICAL INSTRUMENT

BACKGROUND OF THE INVENTION

The distortion produced by electronic amplification of musical instruments, particularly stringed instruments, has been recognised as long as microphones have been used. Correction has been approached in several ways such as (a) use of steel strings, or (b) direct electronic pick-up from the sound box itself. Each of these increases the volume but often with a corresponding loss of clarity or tone. Echo chambers have also been added to the instrument itself and although they add a pleasing element they do not produce a greater initial volume; that is, the strings are not attached directly to the echo chamber and hence it is not a primary sound chamber even though the strings may run through it (e.g. U.S. Pat. No. 853,686 to Feather and Culp). Accordingly it is an object of the present invention to provide a stringed musical instrument having improved clarity and volume due to the stepped shape of the sound box or resonance chamber having an angular bridge to which the strings are directly connected so as to effect vibration of the chamber. Such sound may then of course be further amplified or reverberated as desired, but often no such attachment or construction is desired.

BRIEF SUMMARY

The invention provides stringed musical instruments, exemplified by guitars but including mandolins, banjos, violins, lutes and the like wherein the sound box or amplification/resonance chamber has its top longitudinal walls (one underlying the strings) formed at two (generally parallel) levels, that is, longitudinally stepped or staggered, with one end of the strings anchored to an angularly disposed bridge which is in edge abutment with the two split-level top pieces so that the thus-attached strings directly vibrate the composite chamber.

The result is that the issuing sound from the chamber is enhanced by as much as one-third to one-half without distortion. The "sustain" (the time period during which the tone lasts after a string is plucked) is similarly increased. Nylon strings, which yield greater warmth of tone, may continue to be used where greater volume is required (without having to go to steel strings to obtain such result). Or the present body construction, with steel strings, may be used by musicians in concert, in preference to using electronic amplification. In addition, the size of such stepped-top chambers need not be uniform, but indeed contributes to a particular result. A shallow chamber (such as characterizes a flaminco guitar) yields a more treble tone, while the sound from a deeper chamber is more bass.

The two, stepped-top panels as well as the bottom wall of the sound chamber are generally mutually parallel, and the cross bridge may be tilted back from perpendicular from about 5° to as much as about 75° but generally the range of about 22° to about 27° is optimal. The individual strings may be led through small apertures in the bridge and anchored to the inner surface thereof, most simply just by forming a knot on the end of the string when sufficiently flexible (e.g. nylon). An opening (plus cover) is provided at the adjacent end wall of the chamber to enable the user to reach in and connect new strings from time to time. It should be bourne in mind however that in general the size of the instrument and the length of its strings are the same as what the musician is now using (although of course it could be made in any size), so that he is not using a "different" one as to usage, but rather a better one as to sound.

DETAILED DESCRIPTION OF PREFERRED EMBODIMENT

Figure 1:
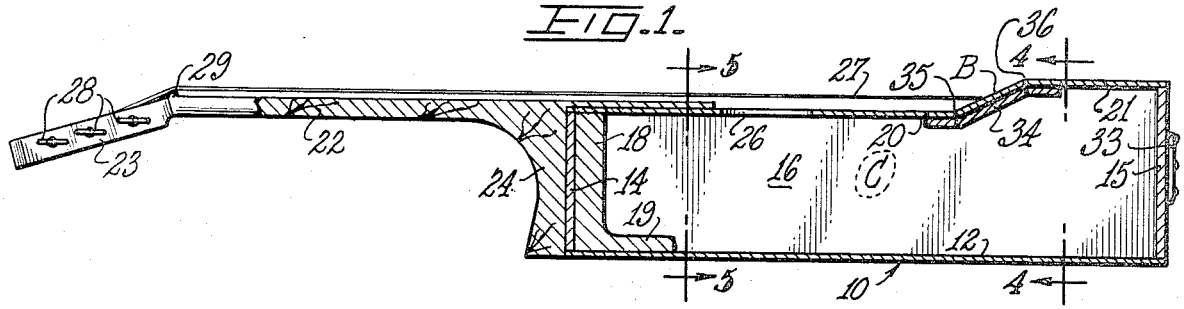
FIG. 1 is a vertical sectional view taken through a guitar which embodies the invention, with the head shown in elevation.
Figure 2:
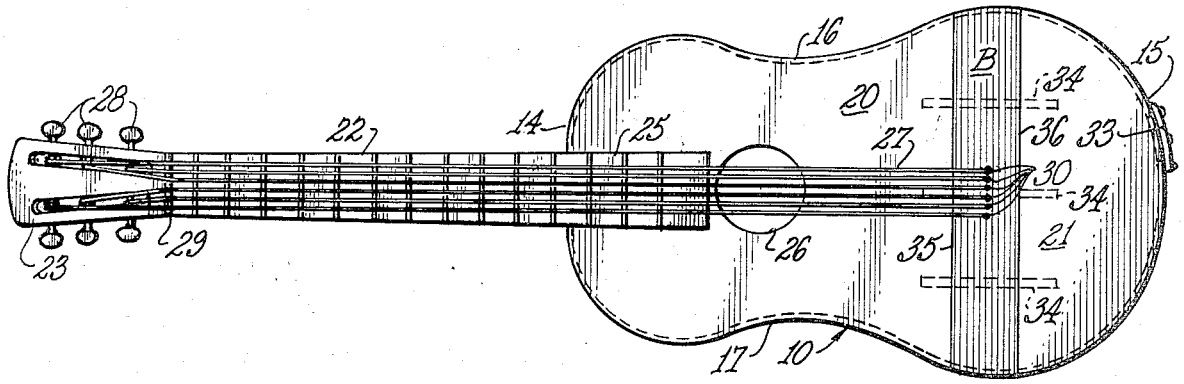
FIG. 2 is a top plan view of the same.
Figure 3:
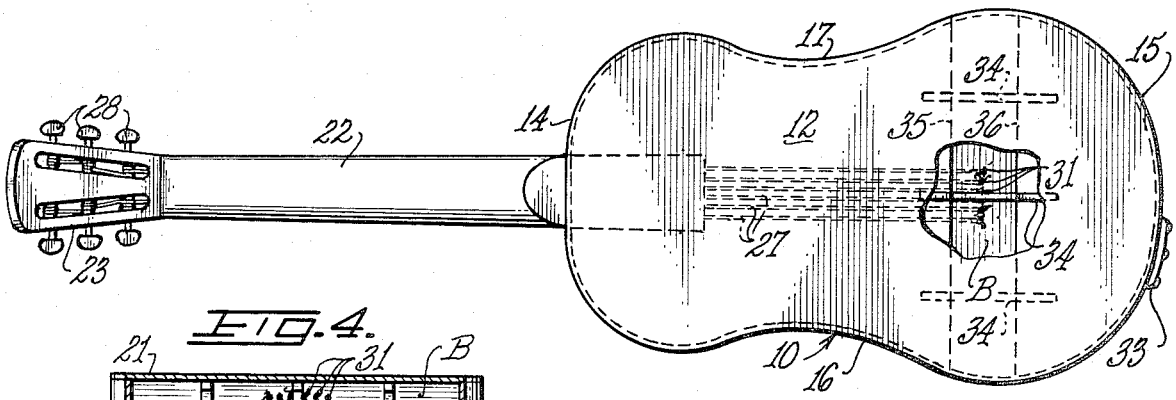
FIG. 3 is a bottom plan view thereof.
Figure 4:
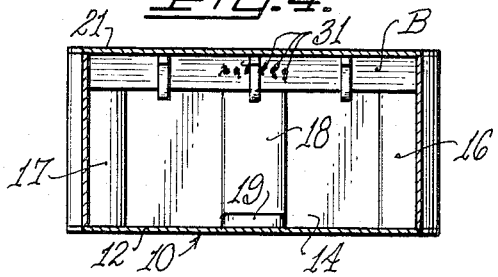
FIG. 4 is a transverse sectional view taken along line 4—4 of FIG. 1 viewed in the direction of the arrows.
Figure 5:
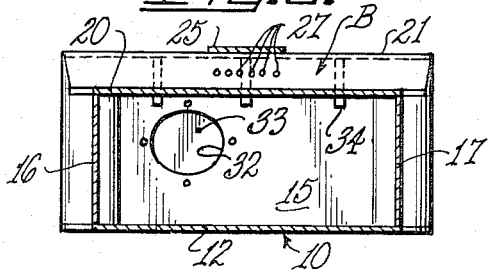
FIG. 5 is a transverse sectional view taken along line 5—5 of FIG. 1.
Figure 6:
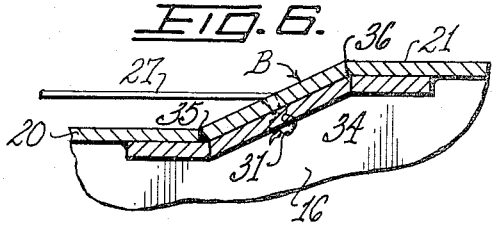
FIG. 6 is an enlarged sectional view taken through the bridge and a support rib along the plane of FIG. 1.

A body 10 is formed by a planar back or flooring surface 12 having its peripheral edge continuously flow-curved in the familiar di-bulbous configuration, with an upstanding wall 14 secured to the edge line of the back so as to form a bottom end (15) and side walls 16, 17 thereof, the mutually inturned side walls being joined together to a transverse support 18 having a foot portion 19 anchored within the chamber C thus outlined. The roof of the sound chamber C is formed by two, generally parallel, top panels 20, 21 located at different heights, and connected by an angularly disposed cross bridge B, that is, upslanted toward the bottom end 15.

The longitudinally separated panels 20, 21 and edge-abutting cross bridge B may each be a separate piece, such as wood, treated cellulose, synthetic resin ("plastic"), and the like. However, it has long been recognised that the inherent temper or structure of the wood which is employed in constructing stringed instruments, as exemplified by Stradivarius violins, contributes greatly to the tone or character of the instrument. For this reason, it is preferred to form the dual-level stepped top and connecting bridge of a single, continuous, unbroken (top) surface of wood in which the grain alignment or axis is upstanding. Starting with an initially flat length or surface, it is first cut or sawed along two crosslines 35, 36 from what will subsequently become the underface; that is, stopping the depth of cut, short of severance. In an atmosphere of steam, the surface is then bent the required amount along each line; that is, UP along line 35, and DOWN along line 36. The cut across 36 is initially wedge shaped and the sides thereof are brought together by the bending. The slit-cut of 35 is filled with resin after being further spread by up-bending. At its finally bent position, the underface is fixedly supported by three short braces or ribs 34 adhesively secured thereto. In summary, the top or outer surface of the "units" 20, B, 21 remains unbroken or continuous, with the wood grain upstanding. The surface can be oiled or surface-treated from time to time like any other wooden violin or similar instrument.

The end wall 15 of the body 10 is formed with an opening 32 of sufficient size for insertion of a person's hand and forearm so as to receive the end of each string 27 threaded through a corresponding opening 31 of the bridge and then to draw it through the arm hole 32 and (manually) form a knot on it. The string can then be pulled taut from the other end until the knot abuts the hole; such procedure is applicable when the string is flexible, such as a nylon string. A curved closure or cover 33 is provided to overlie the opening 32, being removably held by snap fasteners or the like.

Forward from the transverse support 18 is an elongated neck 22 and head 23 with a descending heel portion 24 secured to the body in line with the support 18. The upper surface of the neck 22 provides a customary finger board which continues as a thin extension 25 overlying the panel 20 and extending nearly to a resonance opening 26 of the chamber C.

Strings 27 are held by tensioning pegs 28 which are rotatably mounted in the head 23, the strings passing along aligning grooves of a cross rack or "head nut" 29, and then overlie the successive lengths of the neck 22 and the top panel 20 to be anchored to the bridge B as described.

It will be seen that the sound or resonance chamber C thus produced is not divided or partitioned, but that it is formed of two open (merged) segments or portions of somewhat different heights which, along the top wall, have their respective panels edge-connected by the angular cross bridge which anchors the strings. In one sense, it may be considered that this thus-anchored bridge is vibrated by the strings "against" the interior of the composite chamber, vibrating both the connected walls and the inclosed air. In any event, the effect is quite different from reverberation of a planar top and bottom chamber and/or of an echo chamber appended thereto.

In place of the earlier strings made of "cat gut" and the more modern steel strings, fairly recently strings of synthetic resin or polymers, notably nylon, have come into use. However, the present chamber construction is not limited to its use with any particular kind of strings, nor of any particular material for the split top. The latter may be membraneous material as in a banjo; that is, both split levels are membraneous, connected to the angular cross bridge which may be wood or structurally firm "plastic".

The term "panel" as used in the claims refers to the stepped top segments 20, 21 whether such material is membraneous, wood, plastic, or other material.

I claim:

1. A stringed musical instrument such as a guitar, comprising a head, elongated neck and connected walls forming a sound chamber, said chamber including a split-level top surface formed by respective upper and lower panels longitudinally spaced apart and edge-connected to an angular cross bridge, said panels being disposed generally parallel to each other and to a wall forming the bottom of the chamber so as to form a chamber of different depths corresponding to elevations of the split level top, said elongated neck and lower panel being lengthwise overlaid by tensioned strings extending from said head to said cross bridge and being terminally anchored respectively to the head and to the cross bridge, whereby vibration of a string effects direct vibration of the angular cross bridge, which vibration is transmitted to and reinforced by the underlying sound chamber.

2. An instrument according to claim 1 wherein said angular cross bridge is disposed at an angle of about 22° to about 27° to the plane of said upper and lower panels of the top surface.

3. An instrument according to claim 1 wherein said angular cross bridge is formed with transverse apertures for passage of the respective strings therethrough, which tensioned strings are anchored to an underface of said bridge.

4. An instrument according to claim 1 wherein said strings are formed of synthetic resin such as nylon.

5. An instrument according to claim 1 wherein said split-level top surface including the upper and lower panels and the angular cross bridge are formed of a continuous, unbroken, wooden surface.

6. An instrument according to claim 5 wherein said continuous wooden surface is shaped by cross cuts directed along adjacent panel edge lines, subsequent bending of the surface along said cut lines effected in an atmosphere of heated moisture, and anchoring such bent surface by securing angle-bracing ribs to the underface of the bridge and panels on each side thereof.

7. An instrument according to claim 1 wherein said panels and cross bridge are braced in such split-level disposition by angle-bracing ribs secured jointly to the underface of the bridge and adjacent panels.

* * * * *